United States Patent [19]

Kerstholt

[11] 3,989,297

[45] Nov. 2, 1976

[54] CHAIR OR COUCH WITH A MOVABLE BACK SUPPORT

[76] Inventor: Fritz Kerstholt, Am Wackenbach 11, D 6331 Leun, Germany

[22] Filed: Mar. 21, 1974

[21] Appl. No.: 453,395

[30] Foreign Application Priority Data

Mar. 26, 1973 Germany ..... 7311376[U]
July 13, 1973 Germany ..... 2335586

[52] U.S. Cl. ..... 297/300; 297/306; 297/312; 297/337; 297/355

[51] Int. Cl.[2] ..... A47C 1/024

[58] Field of Search ..... 297/300, 306, 312, 313, 297/304, 305, 337, 354, 355; 248/385; 108/136

[56] References Cited

UNITED STATES PATENTS

| | | | |
|---|---|---|---|
| 1,182,125 | 5/1916 | Whitehead | 297/354 X |
| 1,336,510 | 4/1920 | Collier | 297/305 |
| 1,984,549 | 12/1934 | Rowland | 297/376 X |
| 2,606,595 | 8/1952 | Mednick | 248/385 |
| 2,799,323 | 7/1957 | Berg | 297/312 |
| 2,928,639 | 3/1960 | Shelley | 108/136 |
| 3,046,051 | 7/1962 | Schmidt | 297/306 |
| 3,053,571 | 9/1962 | Fox | 297/300 |
| 3,095,238 | 6/1963 | Tarascon | 297/306 |
| 3,386,770 | 6/1968 | Williams | 297/304 |
| 3,446,532 | 5/1969 | Cramer | 297/313 |
| 3,602,537 | 8/1971 | Kerstholt et al. | 297/304 |
| 3,741,607 | 6/1973 | Cramer | 297/305 |

FOREIGN PATENTS OR APPLICATIONS

| | | | |
|---|---|---|---|
| 1,203,783 | 9/1970 | United Kingdom | 297/304 |

*Primary Examiner*—Roy D. Frazier
*Assistant Examiner*—William E. Lyddane
*Attorney, Agent, or Firm*—Gilbert L. Wells

[57] ABSTRACT

A chair or couch with a base member, a first support carrying a seating surface for supporting the seat of a user and a second support carrying a backrest member for supporting the back of a user, both supports being connected to the base member by hinge means so as each to be pivotably displaceable about a horizontal axis independently of one another under load, clockwise or anti-clockwise, and at least one resilient means so connected to the second support that the latter is resiliently urged towards the back of a user, and the hinge means being so located relative to the first support, that the part of the latter projecting forwardly beyond the axis of rotation is of sufficient extent to permit a user to adjust the inclination of the first support by varying the pressure exerted by his thighs on said part.

42 Claims, 13 Drawing Figures

CHAIR OR COUCH WITH A MOVABLE BACK SUPPORT

CROSS-REFERENCES TO RELATED APPLICATIONS

West German Utility Model (Gebrauchsmuster) G 73 032 34.5, entitled Seat with Backrest, filed Jan. 29, 1973;

Applicant claims priority under 35 U.S.C. 119 for West German Utility Model (Gebrauchsmuster) G 73 11 376.5, entitled Seat with Backrest, filed March 26, 1973; West German Patent Application P 23 35 586.4, entitled Article of Furniture for sitting and/or lying having a movable back, filed July 13, 1973.

BACKGROUND OF THE INVENTION

The field of the invention is chairs and couches provided with a movable back support and with a seat which is pivotably displaceable about a horizontal axle supported in a base. Such chairs are known per se. In one of the known embodiments a coupling between the carrier of the seating surface and the carrier of the backrest or its extension is present in such a manner, that the movements of the backrest cause positively a determined movement of the seating surface, and conversely. Therefore, the usability of said known chairs is limited.

SUMMARY OF THE INVENTION

One purpose of the invention is addressed to the task of creating a new chair or couch allowing the back support and the seat support may be brought into different positions independently of one another, i.e. independently of the instantaneous position of the respective other support, and indeed steplessly.

The object of the present invention is a chair or couch comprising a base member, a first support carrying a seating surface for supporting the seat of a user, a second support carrying a backrest member for supporting the back of a user, the first support being connected to the base member by first hinge means so as to be pivotably about a horizontal axis, clockwise or anti-clockwise, the second support being pivotably connected only to the base member by second hinge means so as to be pivotable about a horizontal axis, clockwise or anti-clockwise, and at least one resilient means connected to the second support that the latter is resiliently urged towards the back of a user, the first and the second support each being pivotably displaceable about the respective hinge means independently of one another under load and positionable in each desired position or held in its position, and the first hinge means being so located relative to the first support, that a part of the first support projecting forwardly beyond the axis of rotation of the first hinge means is sufficient to permit a user without displacing the weight of the latter to adjust the inclination of the first support by varying the pressure, exerted by his thighs, on said forwardly projecting part of the first support. The horizontal axis of the second hinge means may be situated on or in the vicinity of a straight line bisecting the circular arc which a straight line through both hip joints of a user sitting in orderly manner on the first support describes during the simultaneous rearward movement of the first and of the second supports. Further there may be at least one lever arm projecting from the second support, one end portion of the or each lever arm being connected to the second support to pivot therewith and the other end portion of the or each lever arm being connected to the resilient means, the or each lever arm being so disposed relative to the line of action of the resilient means that, on the second support being pivotably displaced in such direction as to increase the force thereon by the resilient means, the leverage exerted on the second support by the resilient means progressivelly increases. Also there may provided at least one clamping device pivotably connected to each of the first and the second supports, each said clamping device being lockable to prevent pivotable displacement of the respective first and second supports with respect to their respective hinge means and each said device being lockable by manual operation of a single fastening device. The latter may be so constructed that it comes into action stepwise during actuation of the single fastening device in such a manner that the respective clamping devices or respective groups of clamping devices are freed or locked successively. Further may be provided a resilient support member at the rear extremity of the first support, the resilient member projecting above the seating surface of the first support to provide support for the pelvis of a user. The chair or couch may be constructed with a second support comprising two components, which are connected together by further hinge means, an outer one of these two components being provided with a member adapted to support the upper part of the back of a user reclining on the couch. Thereby it is possible to provide at least one movement limiting device for the outer component, the or each such limiting device becoming effective in dependence upon the position of the inner component of the second support relative to the base.

The advantage of the new chair or couch lies therein, that the two support parts may be brought into different positions independently of one another. Beyond this, however, the second support during the movement of the first support can be left and possibly fixed in its relative position, which is of importance in particular in the case of application of the article of furniture during operations frequently repeating themselvess and to be carried out in different seating behaviours, for example during application at assembly lines or at writing desks. In these cases, now the first support can be moved together with the user, which even in these more or less short seating phases guarantees a healthy sitting posture and better operating possibilities without possible obstruction by the readjusted second support. By the carrier spring arrangement in connection with the freely movable first support part, there is obtained a sitting comfort, such as may not be achieved with articles of furniture which have previously become known. Beyond this, however, by correct dimensioning of the bearing and of the components of the second support it may be achieved, that the part of the second support coming into contact with the back of the user during its movements in or counter to the clockwise sense does not displace itself along the back of the user, but nearly maintains its relative position. This works out advantageously on the outer clothing of the user, because a displacement and thereby caused crumpling of the same is dispensed with.

The positionability selectable at will of the first support is particularly to be emphasized (under positioning the "bringing into the desired position" and without substantial force expenditure and without alteration of the seating position of the user relative to the first support part "holding in this position" is understood), and indeed inndependently of the respective angular position of the second support part.

BRIEF DESCRIPTION OF THE DRAWINGS

Embodiments of the present invention shown in schematic form in the drawings and described herein with similar considerations applying to the details are:

In FIG. 1, an article of furniture is represented in the form of a chair in a loaded position. In it, there is mounted on a rotatable column mount 12'' a horizontal axle 11. At the latter there is carried rotatably a first support 10 consisting of carrier 10'' and shaped seat 10'. Thus, the first support 10 carries a seating surface for supporting the seat of a user. At the column mount 12' there is laterally mounted an arm 22, which by means of a swivel connection 17 is connected to a second support 18. The latter comprises a frame 18', a joint 20 secured at the latter and a rest plate 19. Thus, the second support 18 carries a backrest member for supporting the back of a user. Thus, the first support 10 is connected to the base member 12' by first hinge means 11 so as to be pivotable about a horizontal axis and the second support 18 is pivotably connected only to the base member 12' by second hinge means 17 so as to be pivotable about a horizontal axis. Also, the frame 18' is provided with a cross strut 21. The base 12' displays a further arm member 23, at the free end of which a telescope spring 24 is rotatably secured as a carrier spring, which by its other end engages rotatably at the cross strut 21 of the frame 18'. Here two correspondingly dimensioned cables 15 are provided as limitors for the movements of the first support part 10.

As evident, the carrier 10'' can rest by its rear end on the frame 18' and, according to relative position of the second support 18, additionally limit the movement of the first support 10 rearwardly. By the spring 24, the second support 18 is pressed by its upper end forwardly upwardly, and so gives constantly a good support of the back of the user. This also then, when the user inclines the seating surface forwardly, because the second support 18 follows this movement correspondingly. The user has the possibility of inclining the first support 10 forwardly and simultaneously the second support 18 so far rearwardly, as he wants, whereby an extended position against spring force is obtained for the user.

Figure 2:
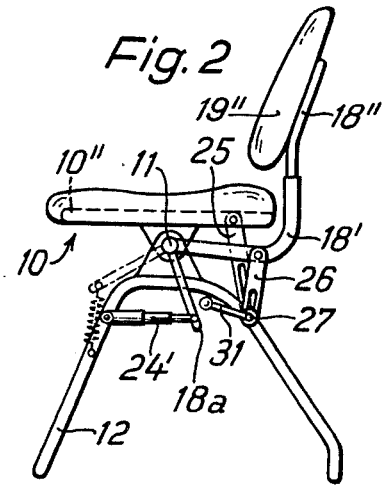
FIG. 2, a chair with arresters for the movements of the support parts.

In the case of the embodiment shown in FIG. 2, which represents a chair in a loaded position, the horizontal axle 11 is mounted on a base 12 manufactured from tubes. The carrier 10'' of the first support part 10, the seating surface of which is adapted to the anatomical shapes of the user, is rotatably borne on this axle. Moreover, however, the frame of the second support is also rotatably mounted on this axle. This frame displays an extension or a lug 18*a*, the free end of which is connected with the base 12 via a spring arrangement in the form of a telescopic spring 24', coming into action stepwise. By this spring arrangement it is made certain, that the spring force acting on the second support, during increasing rearward inclination, increases in a not linear measure, as can be desired, but as cannot be attained with an individual spring. Here, the second support displays a two-part frame 18' and 18'', of which the latter is slightly bent over rearwardly and inserted into the part 18'. By means of a not represented clamping device, the two parts may be fixed in different height positions relative to one another and so different backrest heights may be achieved for the backrest. At the frame 18'' there is secured a backrest part 19'', the lower end of which projects forwardly and supports the part of the upper pelvis edge of the user in an upright seating posture. Both at the carrier 10'' and also at the frame 18' there is rotatably secured, as arrester or clamping device, respective slotted members 25 or 26, which are each constructed as a fishplate with a slotted hole and both of which embrace a fastener pin 27 secured on the base member 12 (see also FIG. 2*a*); the members 25 and 26 are flanked on both sides by clamping plates 28 carried on the pin 27. At the end remote from the base member, the pin 27 carries an axle 29, on which to each side an eccentric plate 30 rotatable by means of a common handle 31 is provided. During actuation of the handle, the clamping plates are pressed against one another and thereby hold the members 25 and 26 in their respective positions. It is therefore possible to fix the first and the second support parts quickly in their respective relative positions by actuation of the handle 31.

Figure 2A:
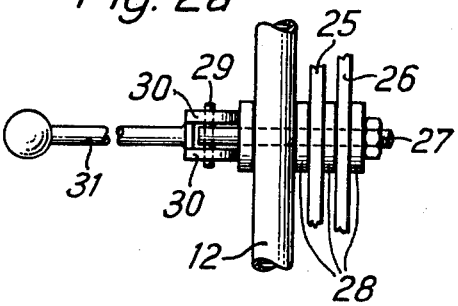
FIG. 2*a*, details of a quick tension device for the arresters.

The device shown in FIG. 2*a* is only one of the possible embodiments. Thus another embodiment is possible, in which instead of the eccentric plates disposed parallel to the fastener pin 27, cam plates disposed perpendicularly to the longitudinal axis of the fastener pin 27 are employed. In this case again the fastener pin 27 is carried on the base of the chair. It carries at its one end a clamping plate, at its other end two cam plates, which act in direction of its longitudinal axis and of which the one is fixed in its relative position, while the other can be swung by means of a handle in the one or the other direction about the longitudinal axis. During the actuation of the handle, the arrester or clamping members surrounding the fastener pin are pressed with the clamping plates situated between them with high force against the base, and so the arresters are held in their instantaneous relative position to the tension pin.

The so far described tensioning devices have the advantage, that the arresters with corresponding dimensioning can simultaneously also take over the function of member to limit the maximum extent of the relative displacement between the two parts of the chair.

As evident, in the case of that shown in FIG. 2, the frame 18' of the second support is strongly curved. Thereby it is achieved, that the second support can follow the back of the user particularly far. This is in particular of use then, when the latter in spite of inclination of the seating surface rearwardly, inclines the upper part of his body very far forwardly.

As is further indicated in the Figure in broken lines, the frame 18' can also be provided with a direct extension, at which then the spring arrangement engaging at the base is secured. In this, this extension, likewise as the lug 18*a*, is, related to the second support, so applied, that during the inclination of the same in the extreme position maximal spring force is thereby obtained, that the effective lever arm extends substantially perpendicularly to the spring draw or to the spring thrust line and thus has a maximal value.

Figure 2B:
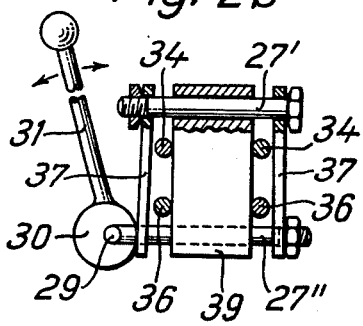
FIG. 2*b*, details of another quick tension device, coming stepwise into action, for the arresters (plan view)

Now it can be desired, that the two support parts may be moved not simultaneously, but successively. In this case, one can provide a fastening device, coming into action stepwise, for the arresters. An example therefor is shown in FIG. 2*b*. The fastener device displays a middle piece 39, which is rigidly connected with the not represented base member of the chair. The middle piece displays at its two ends a respective transverse bore, through which tension bolts 27' and 27'' respectively are guided. The first named tension bolt carries at its one end an inwardly rounded-off abutment, at its other end a thread, on which an inwardly rounded-off screw nut is placed. The other tension bolt, which at its one end likewise displays an abutment, carries at the other end by means of an axle 29 on both sides eccentric plates 30, which are rotatable in common by means of a handle 31.

The two tension bolts are loosely connected to each side of the middle piece 39 by means of strips 37 of spring steel. Between the middle piece and the strips, there pass arrester members 34 and 36 respectively, which are constructed as rods and which are represented in cross-section and of which in this case two disposed opposite to one another are associated with one support part of the article of furniture, the other two with another support part of the article of furniture. The spacing of the strips in the region of the tension bolt 27' is so set, that it is a bit smaller than the width of the middle piece plus the diameter of the two arrester members 34. If now, by means of the handle 31, the eccentric plates are rotated, then initially by means of the strips, on which the eccentric plates exert a pressure, the arrester members 34 are clamped fast, while the arrester members 36 are still freely movable. During the further rotation of the eccentric plates, the strips then bend themselves and clamp fast also the arrester members 36. One therefore has it in the hand by means of this quick tension device, to hold fast only one of the support parts, but to leave the other movable, or however to arrest both support parts.

Figure 3:
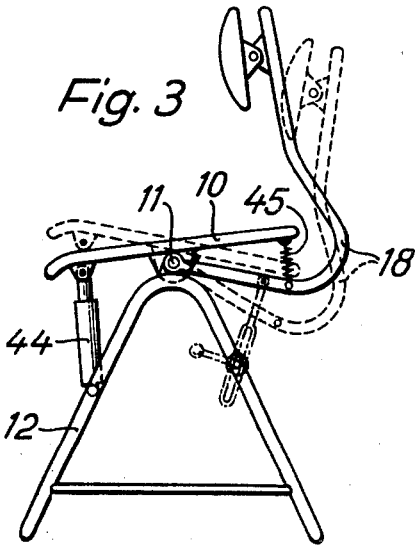
FIG. 3, a further example of a chair embodying the invention.

In FIG. 3, again a chair is represented, in which a first support part 10 as well as a second support part 18 are rotatably mounted on a horizontal axle 11, which is borne on a base 12. As evident, the first support part is connected to the base 12 via a telescopic spring 44, while a further spring 45 is connected between the first and second support parts. The position of the support parts for a rearwardly slightly inclined position is represented in broken lines. By corresponding dimensioning of the spring 45, one achieves a forwardly directed pressure against the back even of a forwardly inclinedly sitting user of the chair. There can be provided a setting device, which permits an adaptation of this pressure to the user. It can further be of use, as likewise indicated, to associate with the second support part an arrester, the position of which can be fixed by means of a tension device mounted at the base.

Figure 4:
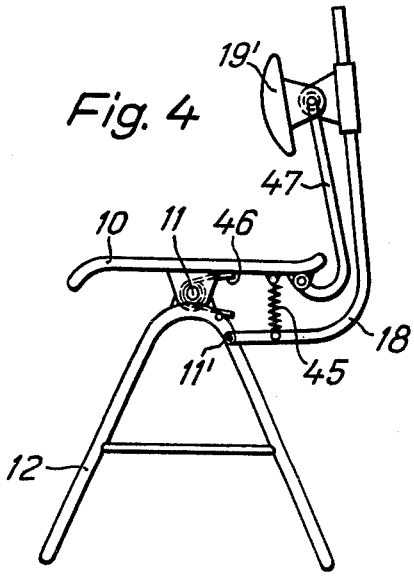
FIG. 4, a chair with controlled rest cushion.

The chair shown in FIG. 4 displays a first support part 10, which is rotatable about the horizontal axle 11 mounted on a base 12 and is braced against this by means of a spring arrangement 46. On a second horizontal axle 11' mounted on the base 12 there is borne the second support part 18, which is coupled to the first support part by means of a spring 45. To avoid a thrust in direction of the longitudinal extent of the second support part during relative movement of first and/or second support part, here the second support part is so executed, that the rest cushion 19' coming into contact with the back of the user is not rigidly mounted at the frame 18, but can slide on the latter. A control arm 47 fitted articulatedly at the first support part takes care thereof, that the rest cushion constantly maintains the correct spacing from the first support part.

Figure 5:
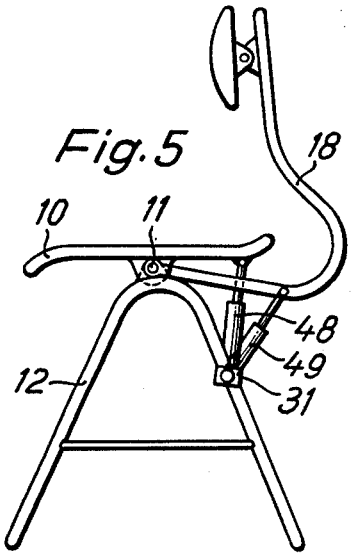
FIG. 5, a chair with spring arrangements in double function.
Figure 5A:
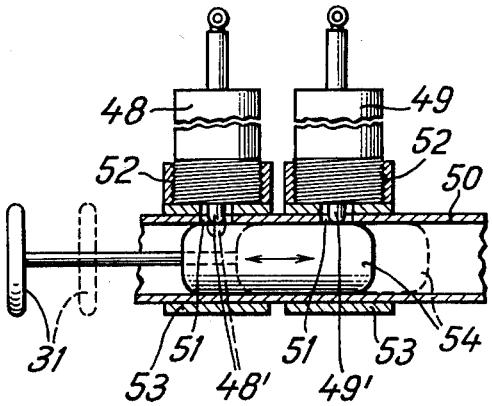
FIG. 5*a*, a control device, coming stepwise into action, for the spring arrangement according to FIG. 5.

In FIG. 5 there is shown a chair, in which the first support part 10 and the second support part 18 are borne on a common rotary axle 11, which is mounted on the base 12. A gas pressure spring 48 is associated with the first support part as a spring arrangement, a gas pressure spring 49 with the second support part. Both gas pressure springs are connected at their lower ends to the base 12 on a common axle. A control device permits the two gas pressure springs, which on account of their technical properties can behave simultaneously as spring arrangement and as arrester means, to be locked stepwise, i.e. simultaneously or temporally successively, in desired sequence, and indeed by means of a single handle. In FIG. 5*a*, an exemplary embodiment for such a control arrangement is shown. The common axle, mounted at the base, for the gas pressure springs is executed as a tube 50, in which recesses 51 are worked in. Each of the gas pressure springs 48, 49 is screwed in by its lower end into a thread 52, which is mounted at right angles at bearing bushes 53, which by their inner diameter are co-ordinated with the outer diameter of the tube 50. In the tube, a control piston 54 is displaceably borne, which is chamfered at its two ends. Its length is so dimensioned, that the control pins 48' and 49' of the gas pressure springs 48 and 49 can rest simultaneously on its not tapered surface. By displacement of the control piston in the one or the other direction (indicated by double arrow) by means of a handle 31 it is possible to lock the two gas pressure springs 48 and 49 selectively individually or simultaneously, and thus to fix or to free the one or the other or both support parts.

Such an article of furniture is then of advantage, when by the user an activity is carried out, in which the user must exert a forwardly directed pressure on a workpiece, for example a jewel grinder.

Of course it also applies here, that it is possible to provide only the second support part with a spring, but to leave the first support part freely movable.

Figure 6:
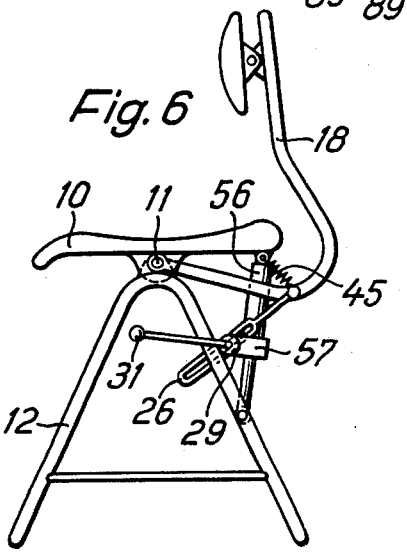
FIGS. 6, 7, other possibilities for the assembly of the tensioning device.
Figure 7:
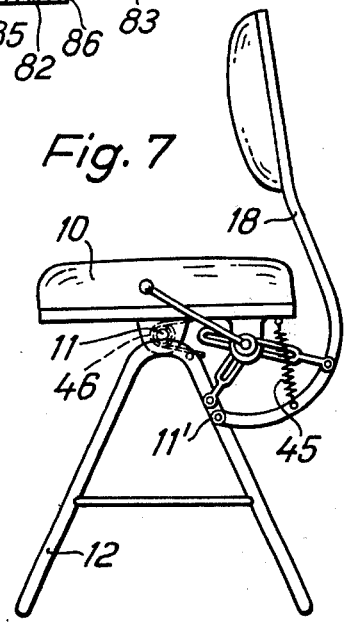

FIGS. 6 and 7 show that the tension device for the arrester means however need not be mounted at the frame. In the case of the embodiment example shown in FIG. 6, the first and the second support part, both of which are rotatable in common about the horizontal axle 11 mounted in the base 12, are connected with one another by means of a spring arrangement 45. Beyond this, the first support part 10 stands in connection with the base via a telescopic spring arrangement 56, in which the sleeve displays at its lower end a clamp 57, which can be drawn together by means of a tension pin 29. At the second support part 18 there is rotatably secured as arrester means a slotted strip member 26, which by its slotted hole surrounds the tension pin 29. During the actuation of the handle 31, both the strip 26 and also the telescopic spring 56 are arrested in their respective position or freed.

In the case of the embodiment example shown in FIG. 7, first and second support parts are borne on separate axles 11 and 11', each mounted on the base 12. Both support parts are interconnected by a spring arrangement 45. Here, the tension device for the arresters is mounted on an arm projecting from the first support part, and the arrester means are rotatably secured at the second support part or at the base. A spring 46 applies spring force between the support parts.

Figure 1:
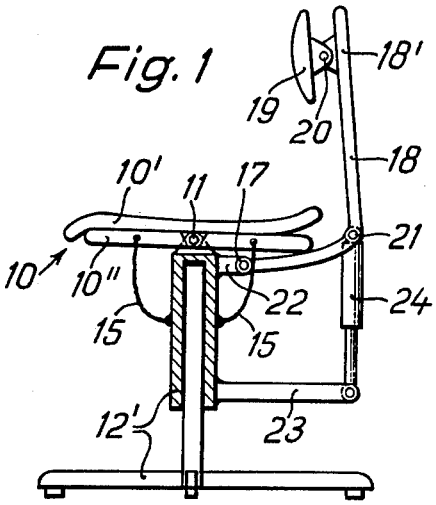
FIG. 1, a chair with rotary support in accordance with one embodiment of the invention.
Figure 8:
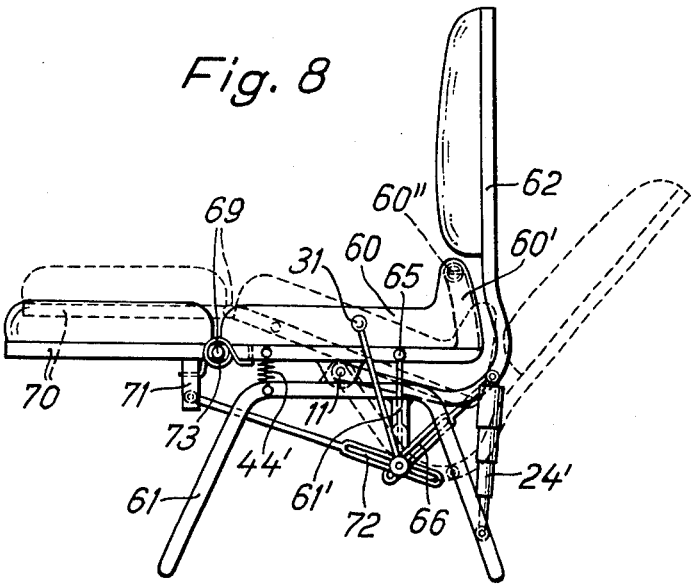
FIG. 8, an easy chair with leg support.
Figure 9:
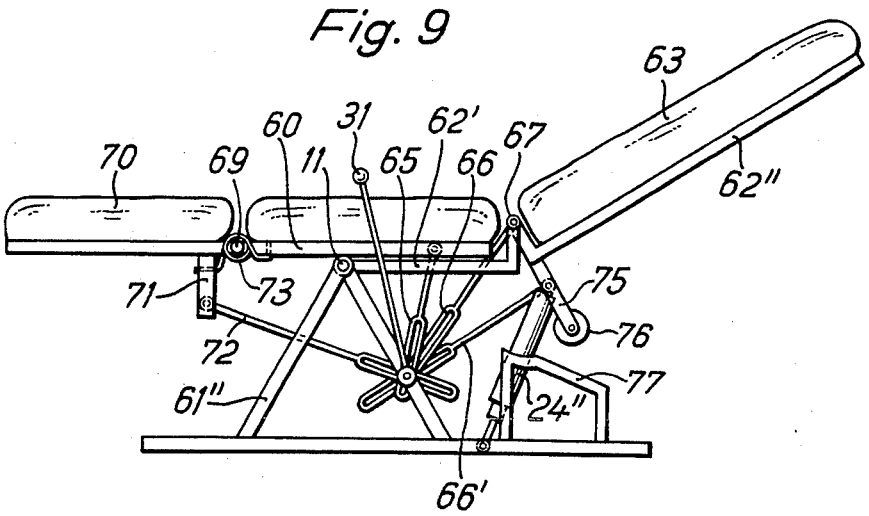
FIG. 9, a couch embodying the invention.

Although the above described embodiments show chairs, the invention nevertheless is certainly not restricted to chairs. It is thoroughly possible to apply the shown principles also in the case of easy chairs or couches, as the examples of FIGS. 8 and 9 show. It is also possiblle to apply the shown details in other than the shown combinations, without thereby the invention being left. This applies for example for the chairs of FIGS. 1, 3 and 4, which of course can also be equipped with arresters and common fastening device or with pressure fluid operable spring means. It is also possible to associate at least one arrester only with the second support part. Finally it is to be mentioned, that with advantage setting devices can be provided, which permit a setting of the force of the applied spring arrangement. This is desired, if alternately persons of different weight use such an article of furniture.

A possible embodiment for an easy chair or couch is shown in FIG. 8. The first upholstered support part 60 is rotatably borne on the base 61 by means of a horizontal axle 11. As evident, the first support part is connected with the base via a spring arrangement 44'. On the same axle 11 there is borne the second, likewise upholstered support part 62, which is supported by means of a rotatably mounted multi-stage spring arrangement 24' against the base. An arrester 65 is associated with the first support part, while an arrester 66 engages at the second support part. Finally, a third support part 70 behaving as a leg support is rotatably mounted by means of a swivel connection 69 at the first support part 60. It is supported against the first support part 60 by means of a spring arrangement 73, and carries a downwardly pointing arm 71, at the free end of which an arrester 72 is rotatably secured. The latter surrounds, together with the arresters 65 and 66, the tension pin of a single common fastening device, which is mounted on an arm 61' of the base and is bringable into and out of action by means of a handle 31. The third support part can, after releasing of the fastening device, also be folded away downwardly and held in this position by usual means.

Although the fastening device only described above is indicated in the drawing, of course also each other tension device, or in corresponding refinement also gas pressure springs with common control device, can be employed. Advantageous is a tension device or control device, which comes stepwise into action and which permits the inclination of the individual support parts without reaction on the other support parts and also can stepwise lock or free more than two arresters or arresters associated with more than two support parts, as is easily visible with the aid of the FIGs. **2*b* and 5*a*** shown by way of example. The operation of the so far described easy chair is substantially the same as in the case of chairs. A reclining position is represented in broken lines.

The support part 60 displays here a profiling deviating from that previously described. As is indicated in broken lines, at the rear end of the carrier of this support part on both sides there are mounted upwardly pointing arms 60', the free ends of which are connected by means of an elastic component 60''. The upholstery of the support part 60 is laid over these additional components. Correspondingly, the upholstery of the second support part is shortened, so that in the case of a second support part standing upright a connection of the upholsteries of first and second support part is obtained. The elastic component 60'' has the task of additionally supporting the back of the user in the region of the upper pelvis edge in particular in the case of rearward inclination.

A possibility for the execution of the subject of the application as a couch is schematically represented in the FIG. 9. A first upholstered support part 60 is rotatably borne on a base 61'' by means of a horizontal axle 11. The second support part, which is borne on the same axle, is here executed in two parts and consists of a part 62', which is bent upwardly at its end turned away from the axle 11. The second part 62'' is at its end turned towards the axle 11 correspondingly upwardly bent, and provided with a rest cushion 63 as a lying surface. Both parts are at their bent-up ends connected with one another by means of a swivel connection 67. At the second part 62'', in extension of the bending-up, there is provided a downwardly pointing lug 75, at which a spring 24'' connecting it with the base engages, and which at its lower end carries a rotatably borne roller 76. The latter can cooperate with a run-up path 77 mounted at the base. The operation of the components 75 to 77 in conjunction with the parts 60, 62' and 62'' is as follows: If by leaning back the user rearwardly inclines the part 62'' against the pressure of the spring arrangement 24 and indeed in particular then, when the first support part 60 is in rearwardly inclined position, then the roller 76 touches down on the run-up path 77. It acts as a limitor. If now nevertheless one inclines the second part 62'' yet further rearwardly, then the lug 75 acts as an abutment, by means of which the second part may indeed incline itself yet further and thereby draws the first part 62' with it upwardly. The latter puts itself under the first support part 60 and raises the latter at its rear end. Via the lever action of the part 62'' in relation to the lug 75, therefore an even lying surface may be achieved.

The step spring arrangement 24'' can also take the place of the lug 75, if it is correspondingly dimensioned, so that in the case of complete pressing together it serves as abutment of correct length and engages at the correct place at the base.

As evident, a third support part 70 behaving as a leg support is mounted by means of a swivel connection 69 at the end of the first support part 60 turned away from the second support part. It is supported against the first support part 60 by means of a spring arrangement 73 indicated in broken lines, and displays at its one end a downwardly directed arm 71, at the free end of which an arrester 72 is rotatably secured. The latter, together with three further arresters 65, 66 and 66', of which the first named is associated with the first support part and the two others with the second support part, surrounds the tension pin of a common tension device, which is mounted at the base and which is bringable into and out of action by means of a handle 31.

With advantage, also here the tension device is so constructed, that one can let the arresters come into action successively. So one has then the possibility of holding fast for example the first and the third support part in their instantaneous position, and moving the second support part on the other hand against the force of the spring arrangement 24''. An important application for this couch is seen in the care of the sick.

It should not remain unmentioned, that in the case of the embodiment example shown in FIG. 9 the arrester associated with the part 62'' can take over the function of the limitor and of the abutment, if the tension device is mounted correspondingly favourably at the base. In this case, the components 76 and 77 can be dispensed with.

It also remains yet to be mentioned, that the carrier spring arrangement for the second support part, instead of at the base, can also engage directly or via an intermediate element at the ground below, if the article of furniture is erected fixedly, as is the case for example in lecture halls or cinemas.

Figure 10:
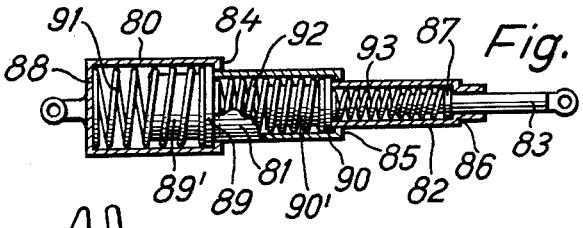
FIG. 10, an example for the resilient means having a non-linear characteristic.

FIG. 10 shows a multiple telescopic spring arrangement having three cases 80, 81 82 and a bar 83. At the top of each case is mounted a ring plate 84, 85, 86, the inner diameter of which is adapted to the outer diameter of an other case or of the bar in the manner that the cases and the bar are guided slidably one in the other. The bar is provided with an outer ring plate 87 and the cases having bearing plates 88, 89, 90. The diameters of the bearing plates 89 and 90 are greater than the outer diameter of the case 81 or case 82 respectively. On the bearing plates 89 and 90 there are mounted projections 89' and 90' forming limiters for the movement of the coordinated cases 81 and 82. Helical springs 91, 92, 93 having different diameters are inserted between said cases and said bar, cooperating with the ring plate of one member and with the bearing plate of the following member in the manner that the ring plate of one member is lying on the bearing plate of an other member respectively. Further there are provided an eye on the bar 83 and on the bearing plate 88 to fasten the spring arrangement. It is to see, that by appropriate dimensioning of the helical springs a spring arrangement having a non-linear characteristic is attained.

I claim:

1. A chair or couch comprising a base member, a first support carrying a seating surface for supporting the seat of a user, a second support carrying a backrest member for supporting the back of a user, said first support connected to said base member by first means for pivoting about a first horizontal axis in clockwise and anti-clockwise direction, said second support connected to said base member by second means for pivoting about a second horizontal axis in clockwise and anti-clockwise direction, and at least one resilient means connected between said second support and one of said base member or said first support for resiliently urging said second support towards the back of a user, said first support and said second support each being pivotably displaceable independently of one another under load throughout the full range of movement about said axes and positionable in given positions and said first horizontal axis coordinated with said first support and located relative to said first support with a portion of said first support projecting forwardly beyond said first horizontal axis a sufficient extent permitting a user to adjust the inclination of said first support by varying the pressure, exerted by his thighs, on said forwardly projecting portion of said first support.

2. A chair or couch comprising a base member, a first support carrying a seating surface for supporting the seat of a user, a second support carrying a backrest member for supporting the back of a user, said first support connected to said base member by first means for pivoting about a first horizontal shaft in clockwise and anti-clockwise direction, said second support connected to said base member by second means for pivoting about a second horizontal shaft, in clockwise and anti-clockwise direction, and at least one resilient means connected between said second support and one of said base member or said first support for resiliently urging said second support towards the back of a user, said first support and said second support each being pivotably displaceable independently of one another under load throughout the full range of movement about said shafts and positionable in given positions and said first horizontal shaft coordinated with said first support and located relative to said first support with a portion of said first support projecting forwardly beyond said first horizontal shaft a sufficient extent permitting a user to adjust the inclination of said first support by varying the pressure, exerted by his thighs, on said forwardly projecting portion of said first support.

3. A chair or couch as claimed in Claim 2, wherein said second horizontal shaft is located in the vicinity of a straight line bisecting the circular arc which a straight line through both hip joints of a user sitting in orderly manner on said first support describes during the simultaneous rearward movement of said first and said second supports.

4. A chair or couch as claimed in Claim 2, wherein said second horizontal shaft is substantially parallel to and next adjacent to said first horizontal shaft.

5. A chair or couch as claimed in claim 2, wherein said horizontal shaft is so located relative to said first support with at least one quarter of the length of said first support projecting forwardly of said first horizontal shaft and at least one quarter of the length of said first support projecting rearwardly of said first horizontal shaft.

6. A chair or couch as claimed in claim 2, wherein said second support and a ground support, to which said base member is attached, are interconnected by said resilient means.

7. A chair or couch as claimed in claim 2, wherein said second support and said base member are interconnected by said resilient means.

8. A chair or couch as claimed in claim 2, comprising further resilient means connected between said first support and said base.

9. A chair or couch as claimed in Claim 2, said resilient means comprising stepwise operable resilient means.

10. A chair or couch as claimed in claim 8, said further resilient means comprising stepwise operable resilient means.

11. A chair or couch as claimed in claim 2, said resilient means comprising at least one pressure fluid operable device.

12. A chair or couch as claimed in claim 8, said further resilient means comprising at least one pressure fluid operable device.

13. A chair or couch as claimed in Claim 2, said resilient means comprising first and second resilient means coordinated to said first and said second supports, each of said first and said second resilient means comprising at least one pressure fluid operable device, each said device selectively lockable by actuation of a single manually operable device.

14. A chair or couch as claimed in Claim 2, comprising at least one clamping device pivotably connected to said second support and lockable by operation of a fastening device to prevent pivotable displacement of said second support about said second horizontal shaft.

15. A chair or couch as claimed in claim 2, comprising at least one clamping device pivotably connected to each of said first and second supports, each said clamping device lockable to provent pivotable displacement of the respective first and second supports with respect to their given positions and each said device being lockable by manual operation of a single fastening device.

16. A chair or couch as claimed in Claim 15, wherein said single fastening device has means for coming into action stepwise during actuation of said single fastening device to free and lock successively said respective clamping devices.

17. A chair or couch as claimed in claim 2, comprising a third support, for supporting the lower legs of a user, connected to said first support by third means for pivoting about a third horizontal shaft, further resilient means connected to said third support for maintaining said third support on a desired operational position, and at least one clamping device selectively lockable by a common single fastening device to retain said third support in its operational position.

18. A chair or couch as claimed in claim 2, comprising a resilient support member provided at the rear extremity of said first support, said resilient member projecting above the seating surface of said first support to provide suppport for the pelvis of a user.

19. A chair or couch as claimed in claim 2, wherein said second support has components with lengths and angular positions relative to one another, and said first horizontal shaft positioned so that, when a user is seated in an upright posture, a portion of the second support coming into contact with the back of the user during the variation of the angular position between said first and said second supports, is maintained at a substantially constant distance apart from a straight line defined by the hip joints of the user.

20. A chair or couch as claimed in claim 2, wherein said second support comprises two components connected together by third means for pivoting, an outer one of said two components being provided with a member adapted to support the upper part of the back of a user reclining on said couch, and wherein at least one movement limiting device is provided for the outer component, said limiting device becoming effective in dependence upon the position of said inner component to said second support relative to said base.

21. A chair or couch as claimed in claim 2, wherein at least one of said resilient means has a non-linear characteristic.

22. A chair or couch as claimed in claim 8, wherein at least one of said resilient means has a non-linear characteristic.

23. A chair or couch comprising, a base member, a first support carrying a seating surface for supporting the seat of a user, a second support carrying a backrest member for supporting the back of a user, a horizontal shaft mounted on said base member, said first support and said second support being pivotably mounted on said horizontal shaft, said first support and said second support being pivotable about said horizontal shaft in clockwise and anti-clockwise direction, and at least one resilient means connected between said second support and one of said base member or said first support for resiliently urging said second support towards the back of a user, said first support and said second support each being pivotably displaceable independently of one another under load throughout the full range of movement about said horizontal shaft and positionable in given positions and said horizontal shaft coordinated with said first support and located relative to said first support with a portion of said first support projecting forwardly beyond said horizontal shaft a sufficient extent permitting a user to adjust the inclination of said first support by varying the pressure, exerted by his thighs, on said forwardly projecting portion of said first support.

24. A chair or couch as claimed in claim 23, wherein said horizontal shaft is so located relative to said first support with at least one quarter of the length of said first support projecting forwardly of said horizontal shaft and at least one quarter of the length of said first support projecting rearwardly of said horizontal shaft.

25. A chair or couch as claimed in claim 23, wherein said second support and a ground support, to which said base member is attached, are interconnected by said resilient means.

26. A chair or couch as claimed in claim 23, wherein said second support and said base member are interconnected by said resilient means.

27. A chair or couch as claimed in claim 23, comprising further resilient means connected between said first support and said base.

28. A chair or couch as claimed in claim 23, said resilient means comprising stepwise operable resilient means.

29. A chair or couch as claimed in claim 27, said further resilient means comprising stepwise operable resilient means.

30. A chair or couch as claimed in claim 23, said resilient means comprising at least one pressure fluid operable device.

31. A chair or couch as claimed in claim 33, said further resilient means comprising at least one pressure fluid operable device.

32. A chair or couch as claimed in claim 23, said resilient means comprising first and second resilient means coordinated to said first and said second supports, each of said first and said second resilient means comprising at least one pressure fluid operable device, each said device selectively lockable by actuation of a single manually operable device.

33. A chair or couch as claimed in claim 23, comprising at least one clamping device pivotably connected to said second support and lockable by operation of a fastening device to prevent pivotable displacement of said second support about said horizontal shaft.

34. A chair or couch as claimed in claim 23, comprising at least one clamping device pivotably connected to each of said first and second supports, each said clamping device lockable to prevent pivotable displacement of the respective first and second supports with respect to their given positions and each said device being lockable by manual operation of a single fastening device.

35. A chair or couch as claimed in claim 34, wherein said single fastening device has means for coming into action stepwise during actuation of said single fastening device to free and lock successively said respective clamping devices.

36. A chair or couch as claimed in claim 23, comprising a third support, for supporting the lower legs of a user, connected to said first support by third means for pivoting about a second horizontal shaft, further resilient means connected to said third support for maintaining said third support on a desired operational position, and at least one clamping device selectively lockable by a common single fastening device to retain said third support in its operational position.

37. A chair or couch as claimed in claim 23, comprising a resilient support member provided at the rear extremity of said first support, said resilient member projecting above the seating surface of said first support to provide support for the pelvis of a user.

38. A chair or couch as claimed in claim 23, wherein said second support has components with lengths and angular positions relative to one another, and said horizontal shaft is positioned so that, when a user is seated in an upright posture, a portion of the second support coming into contact with the back of the user during the variation of the angular position between said first and said second supports, is maintained at a substantially constant distance apart from a straight line defined by the hip joints of the user.

39. A chair or couch as claimed in claim 23, wherein said second support comprises two components connected together by third means for pivoting, an outer one of said two components being provided with a member adapted to support the upper part of the back of a user reclining on said couch and wherein at least one movement limiting device is provided for the outer component, said limiting device becoming effective in dependence upon the position of said inner component to said second support relative to said base.

40. A chair or couch as claimed in claim 23, wherein at least one of said resilient means has a non-linear characteristic.

41. A chair or couch as claimed in claim 27, wherein at least one of said resilient means has a non-linear characteristic.

42. A chair or couch as clained in claim 23, wherein said second support is pivotably mounted on a shaft which is located at least in the vicinity of a straight line bisecting the circular arc which a straight line through both hip joints of a user sitting in orderly manner on said first support described during the simultaneous rearward movement of said first and said second supports.

* * * * *